US008225633B2

(12) United States Patent
Luo et al.

(10) Patent No.: US 8,225,633 B2
(45) Date of Patent: Jul. 24, 2012

(54) ROTATION MECHANISM FOR KEY BLADE

(75) Inventors: Yi Luo, Shanghai (CN); Yuanlong Zhong, Shanghai (CN)

(73) Assignee: Lear Corporation, Southfield, MI (US)

( * ) Notice: Subject to any disclaimer, the term of this patent is extended or adjusted under 35 U.S.C. 154(b) by 288 days.

(21) Appl. No.: 12/041,118

(22) Filed: Mar. 3, 2008

(65) Prior Publication Data

US 2009/0217722 A1 Sep. 3, 2009

(51) Int. Cl.
*A44B 15/00* (2006.01)

(52) U.S. Cl. ..... 70/456 R; 70/459

(58) Field of Classification Search ..... 70/408, 70/1, 456 R, 459; 292/DIG. 37
See application file for complete search history.

(56) References Cited

U.S. PATENT DOCUMENTS

| | | | | |
|---|---|---|---|---|
| 2,822,684 | A * | 2/1958 | Ray | 70/456 R |
| 4,888,970 | A | 12/1989 | Kinzler et al. | |
| 4,941,569 | A * | 7/1990 | Lindmayer et al. | 206/38.1 |
| 5,541,571 | A | 7/1996 | Ochs et al. | |
| 5,943,889 | A | 8/1999 | Chiu | |
| D434,302 | S | 11/2000 | Van Den Acker | |
| 6,216,501 | B1 | 4/2001 | Marquardt et al. | |
| D442,466 | S | 5/2001 | Van Den Acker | |
| 6,499,326 | B1 | 12/2002 | Heussner | |
| 6,647,752 | B1 | 11/2003 | Chaillic | |
| 6,691,539 | B2 | 2/2004 | Jacob et al. | |
| 6,705,141 | B1 * | 3/2004 | Jacob et al. | 70/408 |
| 6,713,895 | B1 | 3/2004 | Krapfl | |
| 6,892,558 | B2 | 5/2005 | Chodosh | |
| 7,055,352 | B2 | 6/2006 | Meyerson et al. | |
| 7,127,922 | B2 | 10/2006 | Khounsombath et al. | |
| 7,370,501 | B2 * | 5/2008 | Miyata et al. | 70/395 |

FOREIGN PATENT DOCUMENTS

EP 1321608 A1 6/2003

* cited by examiner

*Primary Examiner* — Kristina Fulton
(74) *Attorney, Agent, or Firm* — Brooks Kushman P.C.

(57) ABSTRACT

In at least one embodiment, a fob assembly comprising a housing, a mechanical key a spring cover, a spring, and a button is provided. The mechanical key includes includes a key holder for rotation to and from the housing and defines an opening extending therethrough to define a pivot axis. The spring cover is coupled to the key holder and is positioned about opening. The spring cover is adapted to rotate with the key holder. The spring is positioned within the opening and is coupled to the spring cover. The button is coupled to the spring and is adapted to lock the key holder to prevent rotation of the key holder. The button is further adapted to unlock the key holder in response to a force such that the key holder and the spring cover rotate about the pivot axis independent of the button.

15 Claims, 5 Drawing Sheets

ROTATION MECHANISM FOR KEY BLADE

BACKGROUND

1. Technical Field

The embodiments of the present invention generally relate to a remote keyless entry (RKE) fob having a rotatable key blade for a vehicle.

2. Background Art

A number of key fobs have been developed which include rotatable key blades. In one conventional approach, a user may manually grasp the key blade and rotate the key blade from out of a housing of the key fob in the event the key blade is needed to start an engine of the vehicle. In another conventional approach, the key fob may include a button which actuates one or more mechanisms for projecting the key blade from the housing of the key fob. The user may simply fold the key blade back into the housing of the key fob when it is necessary to stow the key blade when not in use.

With the key fob configuration having the button for actuating the key blade, the shape of the button is limited to being circular such that the button is configured to rotate with the key blade as the key blade is rotated from the housing of the key fob. Vehicle designers have no option but to provide circular buttons which limit the design capability of the key fob. Various automotive manufacturers desire to implement stylistic key fobs to consumers as such manufacturers recognize that the consumers associate a social status to the appearance of the key fob. These consumers want the style and appearance of the key fob to be commensurate with the style and design of the particular vehicle they drive.

SUMMARY

In at least one embodiment, a fob assembly comprising a housing, a mechanical key a spring cover, a spring, and a button is provided. The mechanical key includes includes a key holder for rotation to and from the housing and defines an opening extending therethrough to define a pivot axis. The spring cover is coupled to the key holder and is positioned about opening. The spring cover is adapted to rotate with the key holder. The spring is positioned within the opening and is coupled to the spring cover. The button is coupled to the spring and is adapted to lock the key holder to prevent rotation of the key holder. The button is further adapted to unlock the key holder in response to a force such that the key holder and the spring cover rotate about the pivot axis independent of the button.

BRIEF DESCRIPTION OF THE DRAWINGS

The embodiments of the present invention are pointed out with particularity in the appended claims. However, other features of the various embodiments will become more apparent and will be best understood by referring to the following detailed description in conjunction with the accompany drawings in which:

DETAILED DESCRIPTION OF THE PREFERRED EMBODIMENT(S)

As required, detailed embodiments of the present invention are disclosed herein. However, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Moreover, except where otherwise expressly indicated, all numerical quantities in this description and in the claims are to be understood as modified by the word "about" in describing the broader scope of this invention. Practice within any numerical limits stated is generally preferred. Also, unless expressly stated to the contrary, the description of a group or class of materials by suitably or preferred for a given purpose in connection with the invention implies that mixtures of any two or more members of the group or class may be equally suitable or preferred.

The embodiments of the present invention sets out to provide, among other things, a non-rotatable release button as used in connection with a key fob and a mechanical key. Such a characteristic may allow designers to utilize the non-rotatable characteristic so that generally non-circular release buttons may be incorporated with key fobs to satisfy market demand for aesthetically appealing key fobs. It is contemplated that the embodiments of the present invention may also be used in connection with circular release buttons.

Figure 1C:
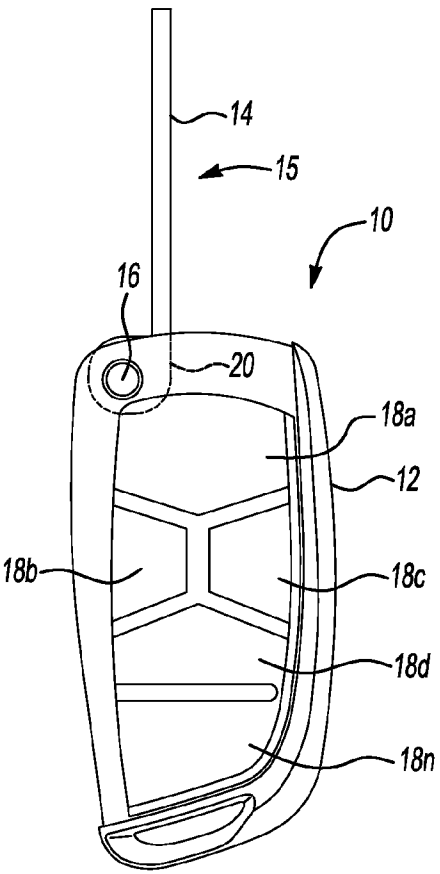
FIGS. 1*a*-1*c* depict a key fob assembly and various positions of a key blade with respect to the key fob assembly.
Figure 1B:
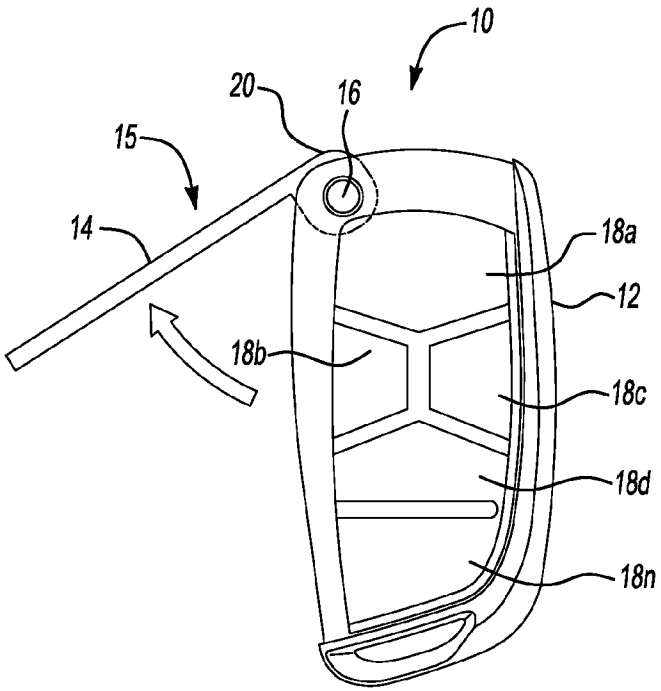
Figure 1A:
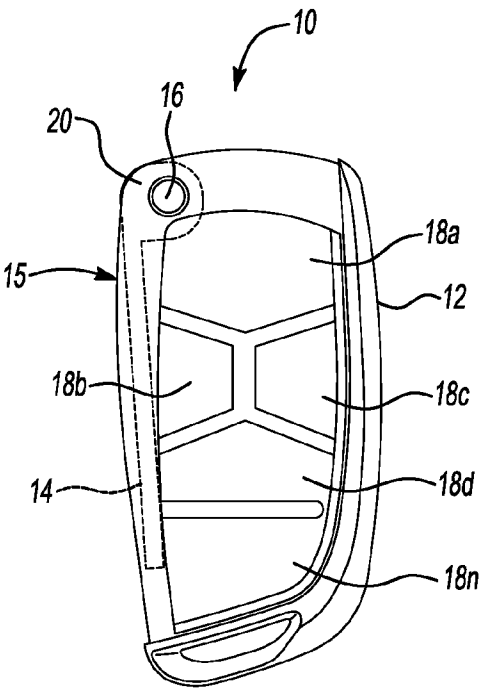

Referring now to FIGS. 1*a*-1*c*, a key fob assembly 10 and various positions of a mechanical key 15 with respect to the key fob assembly 10 are illustrated in accordance to one embodiment of the present invention. The key fob assembly 10 generally includes a housing 12 and the key 15. The housing 12 generally includes a plurality of electrical components for generating radio frequency (RF) signals to control various operations of the vehicle. The key 15 includes a key blade 14 and a key holder 20. As depicted in FIG. 1, the key blade 14 is positioned in a fully stowed position whereby a channel is disposed within the housing 12 for receiving the key 15.

The key fob assembly 10 includes a releasable button 16 and a plurality of key fob switches 18*a*-18*n*. The button 16 deploys the key blade 14 from out of the housing 12 of the key fob assembly 10 (as illustrated in FIG. 1*b*) in response to being depressed by a user. The key blade 14 is generally configured to pivot to a fully deployed state as illustrated in FIG. 1*c*. The key fob switches 18*a*-18*n* may generally correspond to lock, unlock, panic alarm, liftgate\liftglass release or other suitable operations generally performed by a key fob.

Figure 2:
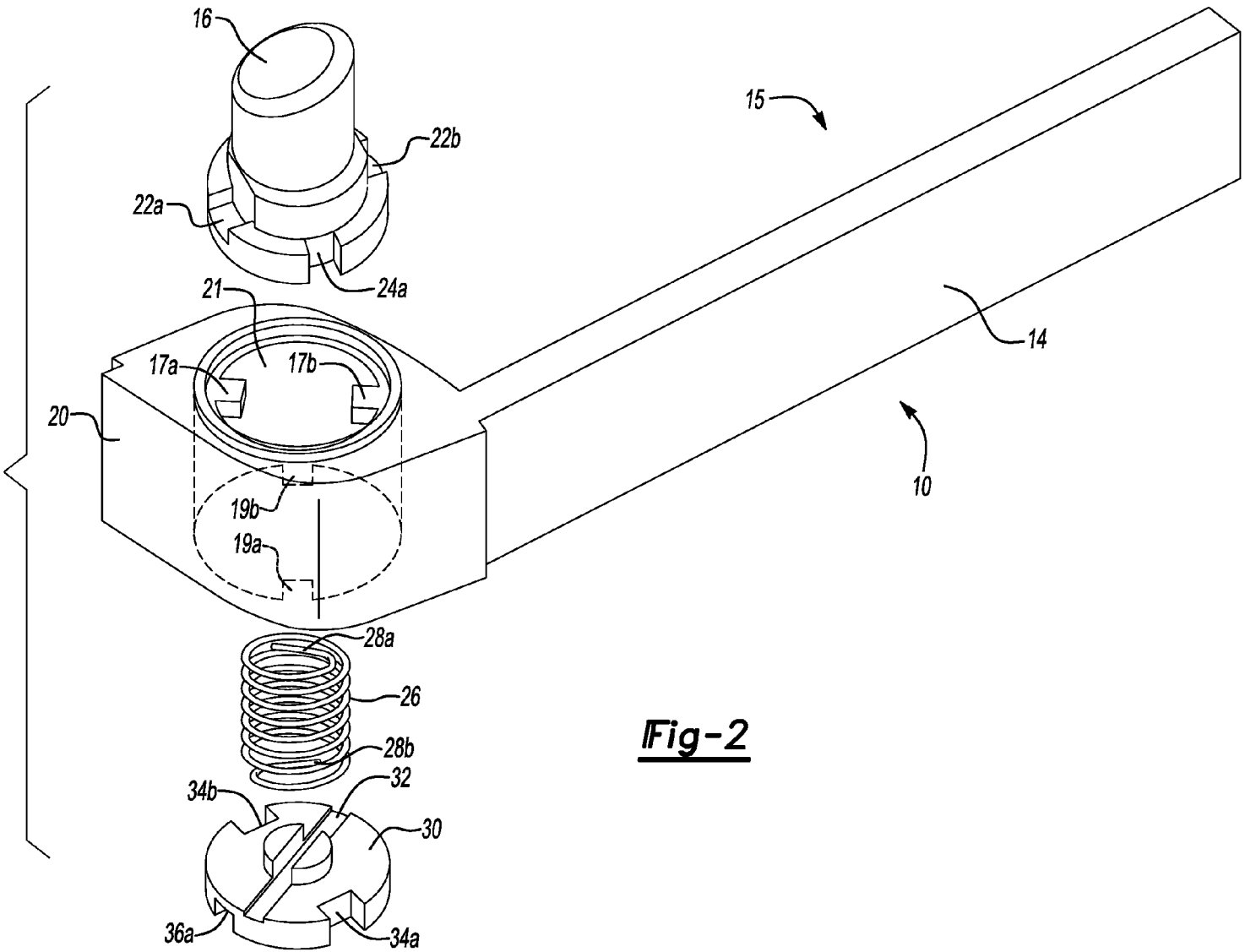
FIG. 2 depicts an exploded view of the key fob assembly.

Referring now to FIG. 2, an exploded view of the key fob assembly 10 is illustrated in accordance to one embodiment of the present invention. The button 16 includes a pair of button receiving notches 22*a*-22*b*. The button receiving notches 22*a*-22*b* are generally configured such that they are positioned 180 degrees apart from one another. The button 16 includes a pair of button assembly notches 24*a*-24*b*. The button assembly notches 24*a*-24*b* are generally configured such that they are positioned 180 degrees apart from one another. The button receiving notch 22*a* is generally positioned 90 degrees from each button assembly notch 24*a* and 24*b*. In a similar manner, the button receiving notch 22*b* is generally positioned 90 degrees from each button assembly notch 24*a* and 24*b*. The button 16 includes a plurality of lips 23. A single lip 23 is positioned between the button receiving notch 22*a* and the button assembly notch 24*a*. Another lip 23 is positioned between the button assembly notch 24*a* and the button receiving notch 22*b*. Likewise, an additional lip 23 is positioned between the button receiving notch 22*b* and the button assembly notch 24*b*.

The key blade 14 and the key holder 20 may be integrated with each other to form the mechanical key 15. Alternatively, the key blade 14 and the key holder 20 may be two separate components coupled together. The key holder 20 includes a first side (or top side) and a second side (or bottom side) positioned opposite to each other. The key holder 20 defines an opening 21 that extends from the first side to the second side. A pair of first holder projections 17*a* and 17*b* are radially positioned about the opening 21 near the top side of the key holder 20. The holder projections 17*a* and 17*b* are positioned 180 degrees apart from each other.

The holder projections 17*a* and 17*b* are generally configured to mate with the button receiving notches 22*a* and 22*b*, respectively. While the holder projections 17*a* and 17*b* are mated with the button receiving notches 22*a* and 22*b*, the key blade 14 is locked and prohibited from rotating to/from the housing 12. A pair of second holder projections 19*a* and 19*b* are radially positioned about the opening 21 at an opposite end of the key holder 20 (e.g., at the bottom of the key holder 20) from where the first holder projections 17*a* and 17*b* are located (e.g., at the top of the key holder 20). The second holder projections 19*a* and 19*b* are positioned 180 degrees apart from each other. The first holder projections 17*a* and 17*b* are generally positioned 90 degrees from the position of the second holder projections 19*a* and 19*b*. A button channel 25 is positioned on the bottom of the button 16 (see FIG. 3*a*).

A spring 26 is generally coupled to the button channel 25 of the button 16. The spring 26 includes spring coupling members 28*a* and 28*b*. The spring coupling members 28*a* and 28*b* are located opposite to each other on the spring 26. The spring coupling member 28*a* is generally mated to the button channel 25. The spring coupling member 28*b* is generally mated to a spring cover 30. The spring cover 30 includes a cover channel 32 for receiving the spring coupling member 28*b* to couple the spring 26 to the spring cover 30. The spring cover 30 includes cover assembly notches 34*a* and 34*b* and cover receiving notches 36*a* and 36*b*. The cover receiving notches 36*a* and 36*b* are generally mated to the second holder projections 19*a* and 19*b* of the key holder 20 such that the spring cover 32 rotates with the key blade 14 and the key holder 20 as the key blade 14 and the key holder 20 pivots from out of the housing 12 and back to the housing 12.

Figure 3A:
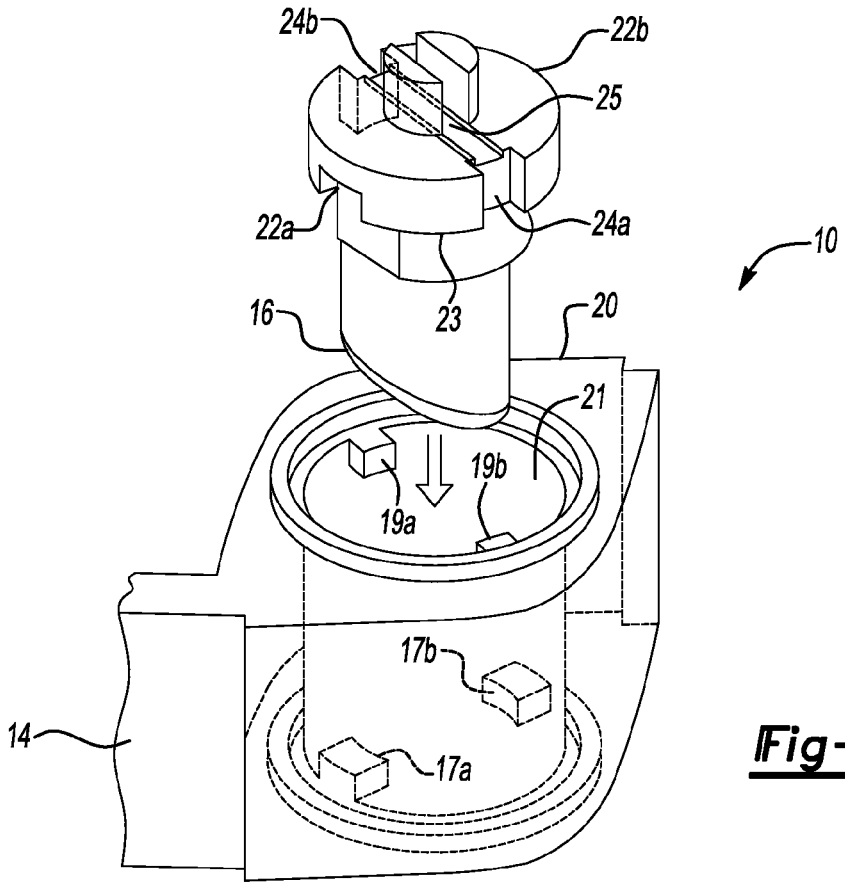
FIGS. 3*a*-3*e* depict perspective views of the key fob assembly while in the process of being assembled.

Referring now to FIGS. 3*a*-3*e*, perspective views of the assembly process of the key fob assembly 10 is generally shown. As shown in FIG. 3*a*, the releasable button 16 is inserted through the opening 21 of the key holder 20. The button 16 is aligned in the opening 21 such that the button assembly notches 24*a* and 24*b* pass over the second holder projections 19*a* and 19*b* of the key holder 20. The button receiving notches 22*a* and 22*b* come into mating engagement with the first holder projections 17*a* and 17*b*, such that the lips 23 are generally flush with a top portion of the key holder 20.

Figure 3B:
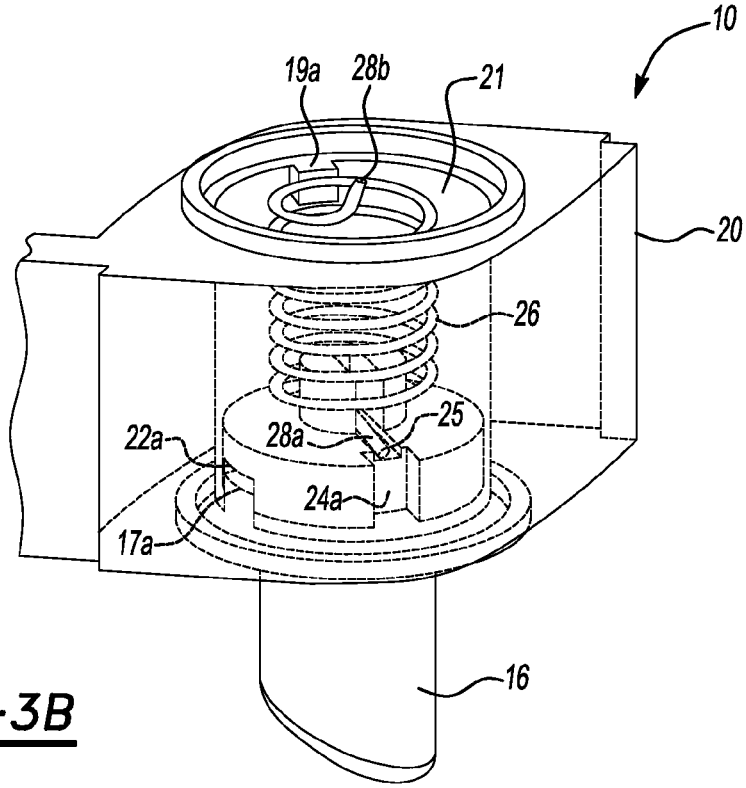
Figure 3C:
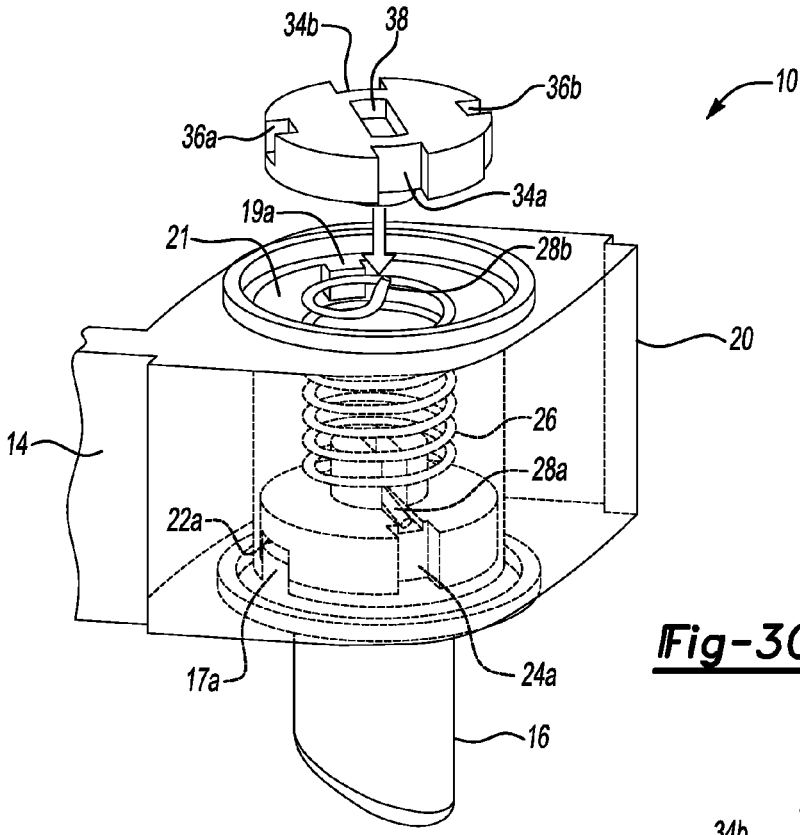
Figure 3D:
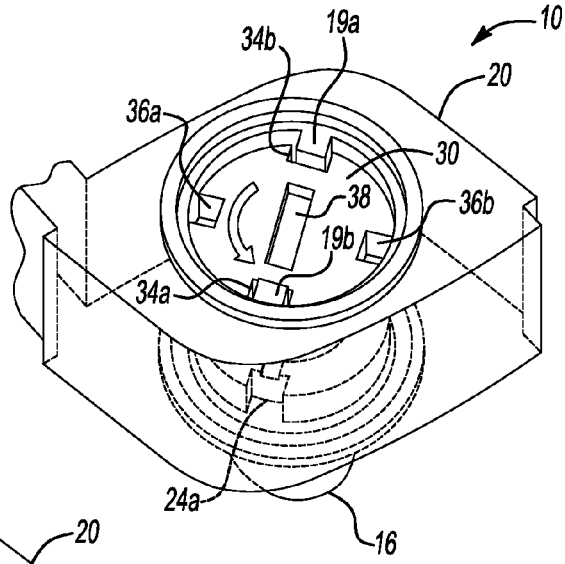
Figure 3E:
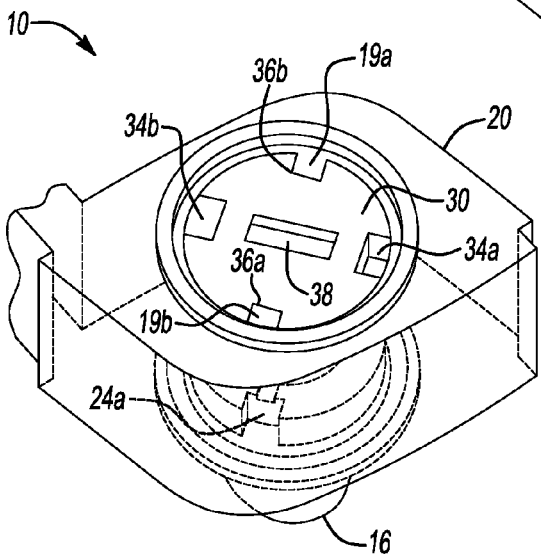

As shown in FIG. 3*b*, the spring coupling member 28*a* is mated to the button channel 25 thereby coupling the spring 26 to the button 16. As shown, the spring 26 is in an uncompressed state. As shown in FIGS. 3*c*-3*e*, the spring cover 30 is aligned over the opening 21 such that the cover assembly notches 34*a*-34*b* pass over the second holder projections 19*a* and 19*b*, respectively. The spring cover 30 is coupled to the spring coupling member 28*b* of the spring 26 (e.g., the spring coupling member 28*b* is mated to the cover channel 32) such that the spring cover 30 compresses the spring 26.

A groove 38 positioned on the spring cover 30 may receive a tool for rotating the spring cover 30 such that the cover receiving notches 36*a* and 36*b* are rotated towards the second holder projections 19*a* and 19*b*, respectively. As the cover receiving notches 36*a* and 36*b* are aligned underneath the second holder projections 19*a* and 19*b*, the tool may be removed from the spring cover 30 such that the spring 26 pushes the cover receiving notches 36*a* and 36*b* toward the second holder projections 19*a* and 19*b* thereby locking the spring cover 30 to the key holder 20. By locking the spring cover 30 to the key holder 20, the spring 26 is loaded to a predetermined torque and compression amount. It is to be noted that the spring 26 is compressed between the spring cover 30 and the button 16 when the spring cover 30 is affixed to the key holder 20. The spring 26 is pre-loaded for rotation while the button 16 is locked (or fixed) to the key holder 20.

Figure 4A:
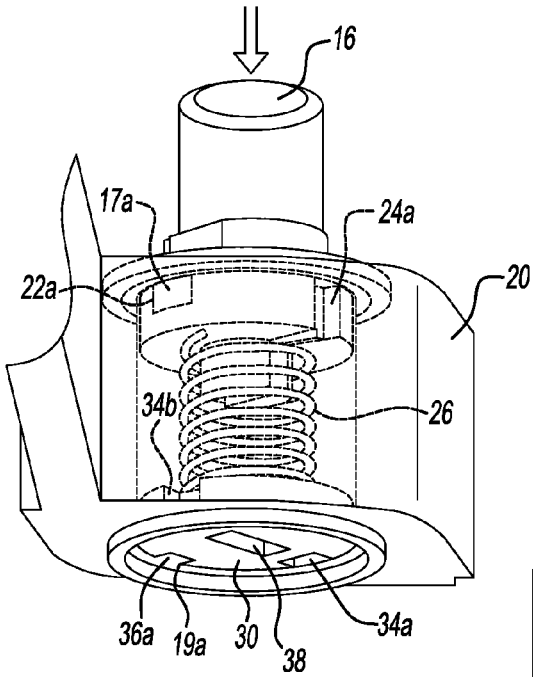
FIGS. 4*a*-4*b* depict the position of the release button when the key blade is in a fully deployed state and in a fully stowed state.
Figure 4B:
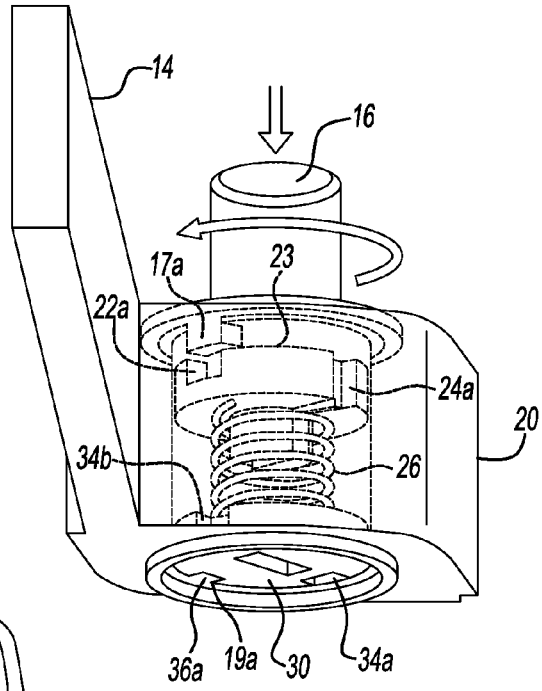

Referring now to FIGS. 4*a*-4*b*, the position of key holder 20 is shown as the key holder 20 (and key blade 14) travels from a stored position to a fully deployed position. FIG. 4*a* depicts the key holder 20 being in a stored state (e.g., the key blade 14 and the key holder 20 being disposed within the housing 12 of the key fob assembly 10). In the stored or locked state, the spring 26 is pre-loaded during the assembly process of the key fob assembly 10 as noted in connection with FIGS. 3*c*-3*e*. The first holder projections 17*a* and 17*b* of the key holder 20 are mated to the button receiving notches 22*a* and 22*b* of the release button 16, respectively. As shown, in the stored state, the spring 26 is in a compressed state and is pre-loaded to a predetermined torque level while the first holder projections 17*a* and 17*b* are locked or mated to the button receiving notches 22*a* and 22*b* of the release button 16.

FIG. 4*b* illustrates the key holder 20 being rotated from out of the housing 12 of the key fob assembly 10. In order to initiate rotational movement of the key holder 20 from the housing 12 of the key fob assembly 10, a user applies a downward force on the button 16. The button 16 is generally configured to move in a liner movement (up or down) and is generally not capable of rotating with the key holder 20 and the key blade 14 as the key holder 20 and the key blade 14 rotate from out of the housing 12. In response to the user applying a downward force to the button 16, the amount of compression against the spring 26 increases while the amount of torque across the spring 26 remains the same and begins to decrease as the rotational angle of the key holder 20 increases. In general, the torque generated by the spring 26 decreases as the key blade 14 rotates closer to being in a fully deployed state. During the rotation of the key holder 20 and prior to the key holder 20 being in a fully deployed state, the first holder projections 17*a* and 17*b* along with the key holder 20 travel along the lips 23 of the button 16. The first holder projections 17*a* and 17*b* rotate along the lips 23 of the button 16 and are not generally capable of being mated to the button assembly notches 24*a* and 24*b*, respectively since the button assembly notches 24*a* and 24*b* are arranged such that the width of each button assembly notch 24*a* and 24*b* are smaller than the width of each first holder projection 17*a* and 17*b*. The spring cover 30 rotates along with the key blade 14 and the key holder 20.

The first holder projection 17*a* is configured to engage the receiving notch 22*b* once the key 15 is fully rotated away from the housing. The first holder projections 17*a* and 17*b* are generally configured to rotate 180 degrees in response to the user depressing the button 16 to place the key blade 14 in the fully deployed state. In response to rotating 180 degrees, the first holder projections 17*a* and 17*b* are mated to the button receiving notches 22*b* and 22*a*, respectively. The first holder projections 17*a* and 17*b* while mated to the button receiving notches 22*b* and 22*a* lock the key holder 20 in the fully deployed state.

Figure 5:
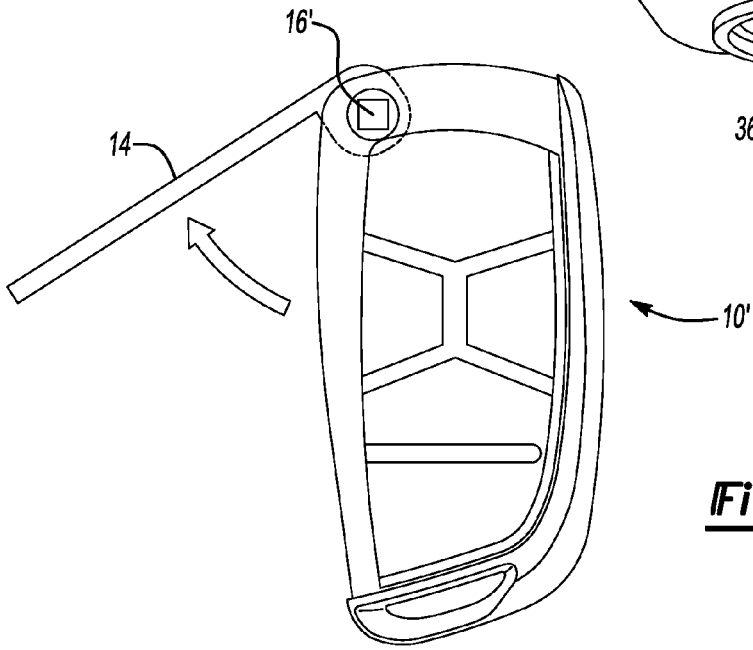
FIG. 5 depicts an alternate embodiment of the key fob assembly.

To retract the key blade 14 back into the stored position within the housing 12, the user depresses the button 16 thereby disengaging the first holder projections 17*a* and 17*b* from the button receiving notches 22*b* and 22*a* and increasing the compression of the spring 26. After the button 16 is released from the key holder 20, the user applies a force to rotate the key blade 14 back toward the housing 12. As the user rotates the key blade 14, the first holder projections 17*a* and 17*b* travel along the lips 23 of the button 16 and rotate 180 degrees until the holder projections 17*a* and 17*b* mate with the button receiving notches 22*a* and 22*b* to lock the key holder 20 in the stored state. While rotating the key blade 14 back to the housing 12, the spring 26 enters into a pre-loaded state (e.g., generates torque) and remains in the pre-loaded state so long as the first holder projections 17*a* and 17*b* are engaged with the button receiving notches 22*a* and 22*b* (e.g., the key blade 14 is in the stored position within the housing 12). FIG. 5 depicts an alternate embodiment of the key fob assembly 10' where the button 16' is generally non-circular. The visible section of the bottom 16' may be shaped in any number of circular or non-circular arrangements.

Reference Numeral List

| | |
|---|---|
| 10 | Key Fob Assembly |
| 10' | Key Fob Assembly |
| 12 | Housing |
| 14 | Key Blade |
| 15 | Key |
| 16 | Button |
| 16' | Button |
| 17a-17b | First Holder Projections |
| 18a-18n | Key Fob Switches |
| 19a-19b | Second Holder Projections |
| 20 | Key Holder |
| 21 | Opening |
| 22a-22b | Button Receiving Notches |
| 23 | Lips |
| 24a-24b | Button Assembly Notches |
| 25 | Button Channel |
| 26 | Spring |
| 28a-28b | Spring Coupling Members |
| 30 | Spring Cover |
| 32 | Cover Channel |
| 34a-34b | Cover Assembly Notches |
| 36a-36b | Cover Receiving Notches |
| 38 | Groove |

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fob assembly comprising:

a housing;

a mechanical key including a key holder for rotation about the housing, wherein the key holder includes first and second sides positioned opposite to each other and the key holder defines an opening extending between the sides for defining a pivot axis;

a spring cover coupled to the key holder to rotate with the key holder;

a spring positioned within the opening and coupled to the spring cover;

a button coupled to the spring and being arranged to lock the key holder to prevent rotation of the key holder, the button to unlock the key holder in response to a force such that the key holder and the spring cover rotate about the pivot axis independent of the button; and a first holder projection and a second holder projection each being positioned within the opening, wherein the assembly defines a first receiving notch for receiving the first holder projection and a second receiving notch for receiving the second holder projection to lock the button to the key holder, and wherein the first holder projection is configured to be released from the first receiving notch and the second holder projection is configured to be released from the second receiving notch in response to the force such that the button unlocks the key holder to enable the key holder and the spring cover to rotate about the pivot axis independent of the button.

2. The fob assembly of claim 1 wherein the button comprises first and second button assembly notches positioned apart from one another.

3. The fob assembly of claim 2 wherein the key holder includes the first holder projection and the second holder projection, the first holder projection and the second holder projection being positioned apart from one another and wherein each button assembly notch is positioned between the first holder projection and the second holder projection.

4. The fob assembly of claim 1 wherein the spring cover comprises at least one cover receiving notch positioned thereon.

5. The fob assembly of claim 4 wherein the key holder comprises one of the first holder projection and the second holder projection positioned thereon and about the second end of the opening, wherein the one of the first holder projection and the second holder projection is coupled to the at least one cover receiving notch.

6. The fob assembly of claim 1 wherein at least a portion of the button visible to a user is shaped in a non-circular manner.

7. The fob assembly of claim 1 wherein the key holder includes the first holder projection and second holder projection, the first holder projection and the second holder projection being positioned apart from one other and about the first side and wherein the key holder further includes a third holder projection and a fourth holder projection positioned apart from one another and about the second side.

8. The fob assembly of claim 7 wherein the first holder projection and the second holder projection are radially positioned out of phase from the third holder projection and fourth holder projection.

9. A fob assembly comprising:

a housing;

a mechanical key including a key holder for rotation to and from the housing, wherein the key holder defines an opening extending therethrough to define a pivot axis;

a spring cover coupled to the key holder and positioned about the opening to rotate with the key holder;

a spring positioned within the opening and coupled to the spring cover;

a button coupled to the spring to lock the key holder to prevent rotation of the key holder, the button to unlock the key holder in response to a force such that the key holder and the spring cover rotate about the pivot axis independent of the button; and a first holder projection and a second holder projection each being positioned within the opening, wherein the assembly defines a first receiving notch for receiving the first holder projection and a second receiving notch for receiving the second holder projection to lock the button to the key holder, and wherein the first holder projection is configured to be released from the first receiving notch and the second holder projection is configured to be released from the second receiving notch in response to the force such that the button unlocks the key holder to enable the key holder and the spring cover to rotate about the pivot axis independent of the button.

10. The fob assembly of claim 9 wherein at least a portion of the button is visible to a user is shaped in a non-circular manner.

11. The fob assembly of claim 9 wherein the key holder includes the first holder projection and second holder projection, the first holder projection and second holder projection being positioned apart from one another and wherein the key holder further includes a third holder projection and a fourth holder projection being positioned apart from one another.

12. A fob assembly; the assembly comprising:

a housing;

a mechanical key including a key holder for rotation to and from the housing, wherein the key holder includes top and bottom sides and the key holder defines an opening extending between the top and bottom sides for defining a pivot axis;

a spring cover coupled to the key holder and positioned about the bottom side of the opening to rotate with the key holder;

a spring positioned within the opening and being coupled to the spring cover; and a button coupled to the spring to lock the key holder to prevent rotation of the key holder, the button to unlock the key holder in response to a force such that the key holder and the spring cover rotate about the pivot axis independent of the button;

wherein the key holder includes:

a first holder projection and a second holder projection being positioned apart from each another and about the top side; and a third holder projection and a fourth holder projection being positioned apart from each other and about the bottom side.

13. The fob assembly of claim 12 wherein the first holder projection and the second holder projection are positioned within the opening and wherein the assembly defines a first receiving notch and a second receiving notch for receiving the first holder projection and the second holder projection, respectively, to lock the button to the key holder.

14. The fob assembly of claim 13 wherein the first holder projection and the second holder projection are configured to be released from the first receiving notch and the second receiving notch, respectively, in response to the force such that the button unlocks the key holder to enable the key holder and the spring cover to rotate about the pivot axis independent of the button.

15. The fob assembly of claim 12 wherein at least a portion of the button is visible to a user is shaped in a non-circular manner.

* * * * *

UNITED STATES PATENT AND TRADEMARK OFFICE

CERTIFICATE OF CORRECTION

PATENT NO. : 8,225,633 B2
APPLICATION NO. : 12/041118
DATED : July 24, 2012
INVENTOR(S) : Yi Luo et al.

It is certified that error appears in the above-identified patent and that said Letters Patent is hereby corrected as shown below:

Column 6, line 46, claim 7:

After "positioned apart from" delete "other" and insert -- another --.

Signed and Sealed this
Twenty-seventh Day of November, 2012

David J. Kappos

David J. Kappos
*Director of the United States Patent and Trademark Office*